US010408136B2

(12) United States Patent
Pattullo

(10) Patent No.: US 10,408,136 B2
(45) Date of Patent: Sep. 10, 2019

(54) THROTTLE TRIGGER ACTUATED THROTTLE POSITION SENSOR AND ENGINE CONTROL MODULE

(71) Applicant: Walbro LLC, Tucson, AZ (US)

(72) Inventor: George M. Pattullo, Caro, MI (US)

(73) Assignee: Walbro LLC, Tucson, AZ (US)

( * ) Notice: Subject to any disclaimer, the term of this patent is extended or adjusted under 35 U.S.C. 154(b) by 0 days.

(21) Appl. No.: 15/778,492

(22) PCT Filed: Nov. 22, 2016

(86) PCT No.: PCT/US2016/063243
§ 371 (c)(1),
(2) Date: May 23, 2018

(87) PCT Pub. No.: WO2017/091537
PCT Pub. Date: Jun. 1, 2017

(65) Prior Publication Data

US 2018/0334969 A1 Nov. 22, 2018

Related U.S. Application Data

(60) Provisional application No. 62/259,453, filed on Nov. 24, 2015.

(51) Int. Cl.
*F02D 9/02* (2006.01)
*F02B 63/02* (2006.01)
(Continued)

(52) U.S. Cl.
CPC ..... *F02D 9/02* (2013.01); *F02B 63/02* (2013.01); *F02D 11/04* (2013.01); *F02D 41/26* (2013.01);
(Continued)

(58) Field of Classification Search
CPC . F02D 9/02; F02D 11/04; F02D 41/26; F02D 2009/0208; F02D 2009/0294; F02D 2200/60; F02B 63/02; F02P 5/005
See application file for complete search history.

(56) References Cited

U.S. PATENT DOCUMENTS 4,213,513 A 7/1980 Beck
4,989,451 A 2/1991 Ogawa
(Continued)

FOREIGN PATENT DOCUMENTS

EP 0670471 A1 9/1995
EP 1541836 A1 6/2005
(Continued)

OTHER PUBLICATIONS

Swedish Office Action and Search Report dated May 17, 2019 in Swedish Patent Application No. 1850619-6 (10 pages).
(Continued)

*Primary Examiner* — Hieu T Vo
(74) *Attorney, Agent, or Firm* — Reising Ethington P.C.

(57) ABSTRACT

An engine kill switch and a throttle lever position sensor switch both remote from the engine and connected by a pair of wires to a microcontroller for controlling a spark initiated combustion of an air-fuel mixture in a cylinder of the engine. The switches may be received in the same housing and mounted in an operator handle housing of a hand held power tool.

23 Claims, 7 Drawing Sheets

(51) Int. Cl.

| | |
|---|---|
| ***F02D 11/04*** | (2006.01) |
| ***F02D 41/26*** | (2006.01) |
| ***F02P 5/00*** | (2006.01) |

(52) U.S. Cl.
CPC ..... *F02P 5/005* (2013.01); *F02D 2009/0208* (2013.01); *F02D 2009/0294* (2013.01); *F02D 2200/60* (2013.01)

(56) References Cited

U.S. PATENT DOCUMENTS

| | | | | |
|---|---|---|---|---|
| 5,203,302 | A | 4/1993 | Parnitzke | |
| 5,401,928 | A | 3/1995 | Kelley | |
| 5,551,395 | A | 9/1996 | Isaacs | |
| 7,448,358 | B2 | 11/2008 | Andersson et al. | |
| 7,546,836 | B2 | 6/2009 | Andersson et al. | |
| 8,246,510 | B2 * | 8/2012 | Michishita ..... | B60K 6/34 477/20 |
| 2010/0147544 | A1 | 6/2010 | Yoshizaki | |
| 2013/0343906 | A1 | 12/2013 | Funke et al. | |
| 2014/0028332 | A1 | 1/2014 | Praeger | |

FOREIGN PATENT DOCUMENTS

| | | | |
|---|---|---|---|
| JP | 0849574 | A | 2/1996 |
| WO | 2014150742 | A1 | 9/2014 |

OTHER PUBLICATIONS

Written Opinion & International Search Report for PCT/US2016/063243 dated Mar. 10, 2017, 18 pages.

* cited by examiner

THROTTLE TRIGGER ACTUATED THROTTLE POSITION SENSOR AND ENGINE CONTROL MODULE

REFERENCE TO RELATED APPLICATION

This patent application claims the benefit of the earlier filed U.S. provisional patent application, Ser. No. 62/259,453, filed on Nov. 24, 2015, which is incorporated herein by reference in its entirety.

TECHNICAL FIELD

The present disclosure relates generally to internal combustion engines and more particularly to a control system with a remote sensor of the throttle valve position of a carburetor or other device supplying a fuel and air mixture to a small engine.

BACKGROUND

Small internal combustion engines are used to power a variety of various products such as chain saws, leaf blowers, lawn mowers, edgers, grass and weed trimmers, and the like. Many of these engines are single cylinder two-stroke or four-stroke gasoline powered internal combustion engines having a carburetor or other device with a throttle valve controlling the fuel and air mixture supplied to the operating engine. Many of these products have a manually movable throttle lever or trigger remote from the throttle valve that controls the opening and closing of the throttle valve and in close proximity a kill switch connected to an ignition control module by two terminals and two wires so that closing of the normally open kill switch causes the ignition module to terminate supplying an electric current to a spark plug of the engine and thus stopping operation of the engine. Typically, these engines do not have a separate battery for supplying an electric current to the spark plug and instead utilize a magneto system with magnets mounted on the flywheel to generate power for a capacitive discharge ignition system of the module which typically also varies and controls ignition timing of the current at a high potential voltage supplied to the spark plug. Typically, these engines are manually cranked for starting with an automatic recoil rope starter.

For many engine control systems, it would be desirable to sense when the throttle valve is near or at its wide open throttle (WOT) position for one or more of a variety of purposes including without limitation initiating automatic or self-adjustment of the ratio of fuel-to-air in the mixture, cancelling a centrifugal clutch engagement limiter feature when the operator advances the throttle valve from fast idle or idle to a wide open throttle (WOT) position, initiating active engine acceleration such as by advancing ignition timing and/or fuel enrichment of the fuel-air mixture supplied to the engine, activating engine rapid comedown enhancement from WOT to idle such as by retarding ignition timing and enleaning fuel in the fuel-air mixture, etc.

SUMMARY

In at least some implementations, an electric switch may be in a location remote from an engine throttle valve, such as in the control handle of a handheld product, will change state such as by movement of a throttle lever or trigger carried by the control handle when the trigger is moved near to or at its WOT position. In at least some implementations, this electric switch and related circuitry may use the same two wires utilized by a conventional kill switch to stop operation of the engine. In at least some implementations, both the throttle position and kill switches may be in the same housing and may use the same terminals to connect with the same two wires to connect both switches with a microcontroller of an engine ignition control module.

In at least some implementations, a control module for a spark ignited engine with a remote trigger of a throttle lever may include a microcontroller controlling the spark initiated combustion of an air-fuel mixture, an engine kill switch remote from the engine and connected by one of a pair of wires to the microcontroller to stop engine operation when manually actuated to change the state of a pair of its contacts, and a throttle lever position sensor switch remote from the engine throttle valve and connected by the other of the same pair of wires to the microcontroller to signal when the trigger is moved to near or at its wide open throttle position.

BRIEF DESCRIPTION OF THE DRAWINGS

The following detailed description of preferred embodiments and best mode will be set forth with reference to the accompanying drawings, in which.

DETAILED DESCRIPTION

Figure 1:
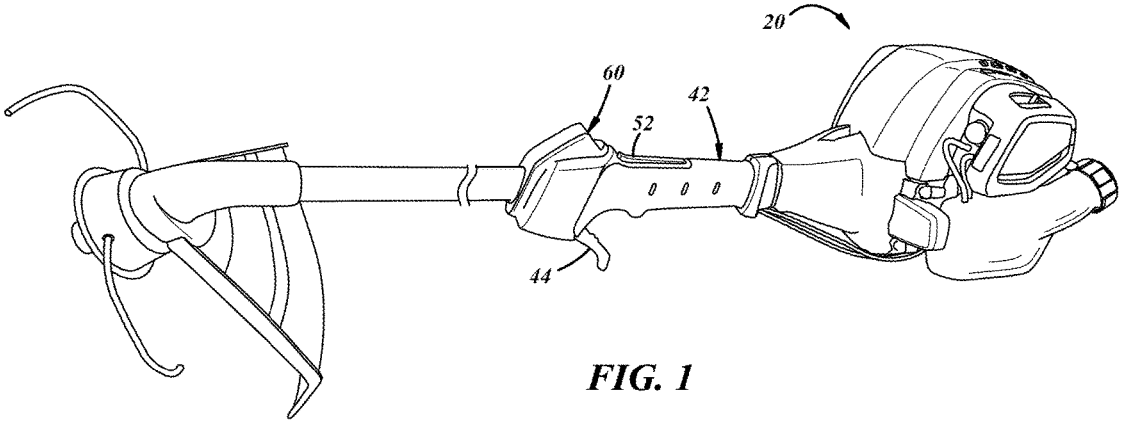
FIG. 1 is a perspective fragmentary view of a grass and weed trimmer embodying the invention.
Figure 2:
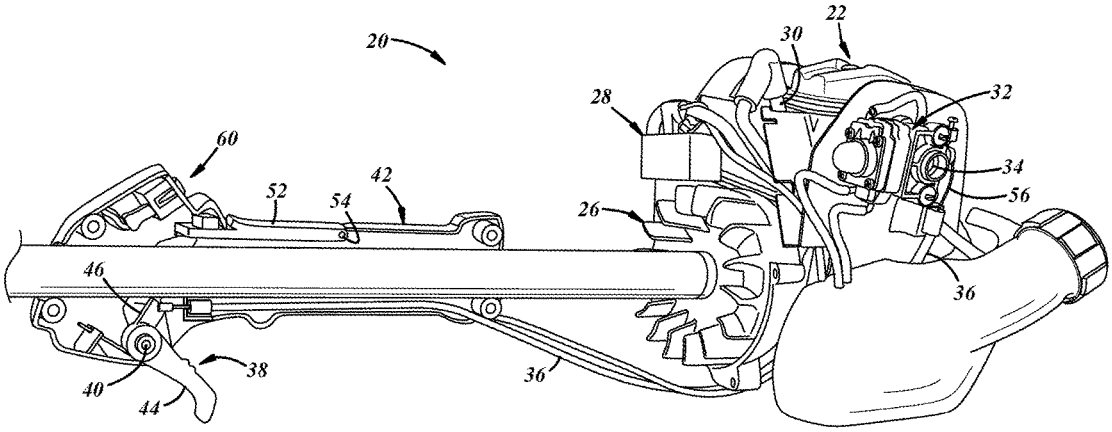
FIG. 2 is a fragmentary perspective view with some housings removed of the trimmer of FIG. 1.

FIGS. 1 and 2 illustrate a handheld power tool or product in the form of a grass and weed string trimmer 20 powered by a small or light duty internal combustion engine 22. Typically, this engine is a light duty single cylinder two-stroke or four-stroke gasoline powered internal combustion engine. In this engine, a single piston is slidably received for reciprocation in a cylinder and connected by a tie rod to a crankshaft 24 attached to a flywheel 26. Typically, this engine has a capacitive discharge ignition system (CDI) module 28 for supplying a high voltage ignition pulse to a spark plug 30 for igniting an air-fuel mixture in the engine cylinder combustion chamber. This module varies and controls the ignition timing relative to the top dead center position of the piston in response to changing engine operating conditions.

Typically, this engine does not have any battery supplying an electric current to the spark plug or powering the control module which typically includes a microcontroller. Typically, this engine is manually cranked for starting with an automatic recoil rope starter.

This engine typically has a carburetor with a throttle valve, controlling the supply of an air-fuel mixture for starting and operating the engine. In lieu of a carburetor, some engines may have an air intake with a throttle valve controlling air flow into the engine and a fuel injector or other device injecting fuel into either the air flow or directly into the cylinder of the internal combustion engine. The fuel injector or other device is controlled by circuitry of a module to supply the desired quantity of fuel for varying engine operating conditions.

The term "light-duty combustion engine" broadly includes all types of non-automotive combustion engines including two and four-stroke gasoline powered engines used in various devices or products including lawn and garden equipment, lawn mowers, snow blowers, personal watercraft, boats, snowmobiles, motorcycles, all terrain vehicles, and a variety of handheld power tools including grass and weed trimmers, edgers, chain saws, air blowers, leaf blowers, etc.

As shown in FIGS. 1 and 2, the engine has a carburetor 32 having a throttle valve 34, typically a rotary barrel or butterfly valve, connected by a Bowden wire 36 to a manually operable throttle lever 38 pivotally mounted 40 in a handle housing 42 of the trimmer. The throttle lever has a manually engageable trigger 44 extending outwardly of the handle housing and an arm 46 extending generally radially relative to the pivot 40 and preferably at about a right angle to the trigger 44. At its distal end, this arm has a generally axially extending dog 48 releasably engageable with a stop 50 on a safety release latch 52 pivotally mounted adjacent its other end in the handle housing on a pivot axis 54 preferably parallel to the pivot axis 40 of the throttle lever 38. The safety latch 52 retains the throttle lever 38 in its idle position (FIG. 3) until the safety latch is manually depressed to disengage its stop 50 from the dog 48 to thereby permit manually moving the trigger 44 and thus the throttle lever 38 from its idle position toward and to its wide open throttle (WOT) position (FIG. 4) to move the wire 56 of the flexible Bowden cable assembly 36 to move the carburetor throttle valve 34 from its idle position toward and to its wide open position. The safety latch 38 is yieldably biased to its latched position by a leaf spring 58.

In accordance with a feature of this invention, a dual switch assembly 60 has a throttle lever position sensor switch 62 and an engine kill switch 64 preferably, but not necessarily, both in the same housing 66. Preferably, housing 66 is mounted in the same location 68 in the handle housing as a conventional engine kill switch. This dual switch assembly 60 has two preferably spade connector terminals 70, 72 one of which is connected to a ground wire 74 and the other is connected to a module communication wire 76 for the purposes of sending through these wires and to the module 28 one signal when the throttle lever 38 is near or at its WOT position and another signal to kill the engine when the operator manually actuates a rocker button 78 of the kill switch 64 to stop operation of the engine. In prior art trimmers and the like, a manually actuated conventional rocker switch only provides a signal to kill or stop the operating engine typically by a control circuit microcontroller discontinuing or stopping the application of the high potential voltage to the spark plug so that it does not ignite any air-fuel mixture in the engine cylinder. The switch housing 68 is electrically non-conductive and insulative and may be a plastic housing.

Figure 5:
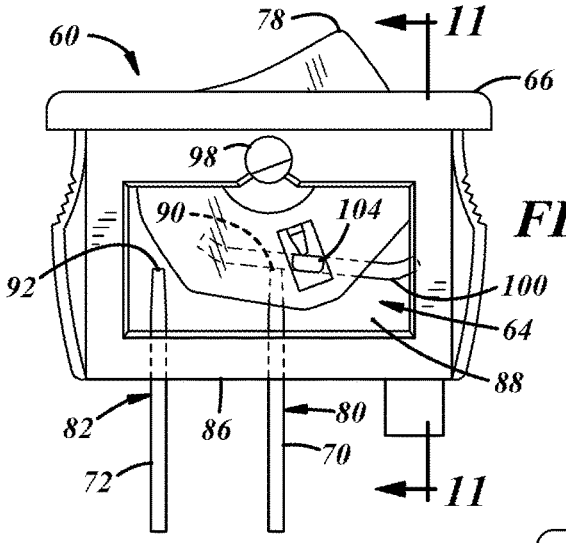
FIG. 5 is an enlarged sectional side view of the kill switch portion of the combined switch assembly in its open position.
Figure 6:
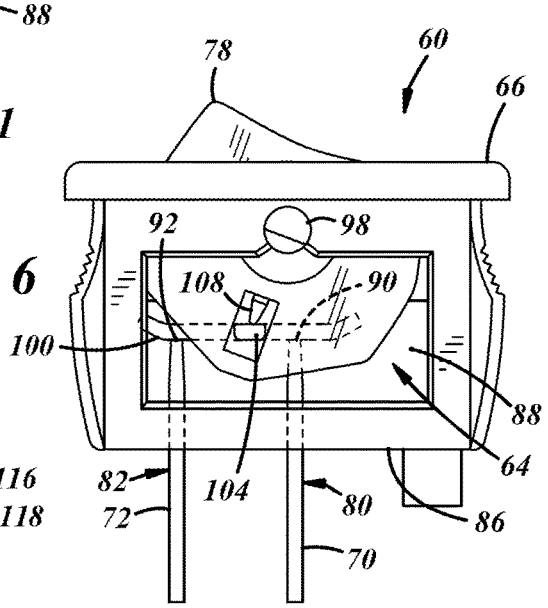
FIG. 6 is an enlarged sectional side view of the kill switch portion of the combined switch assembly in its closed position.
Figure 7:
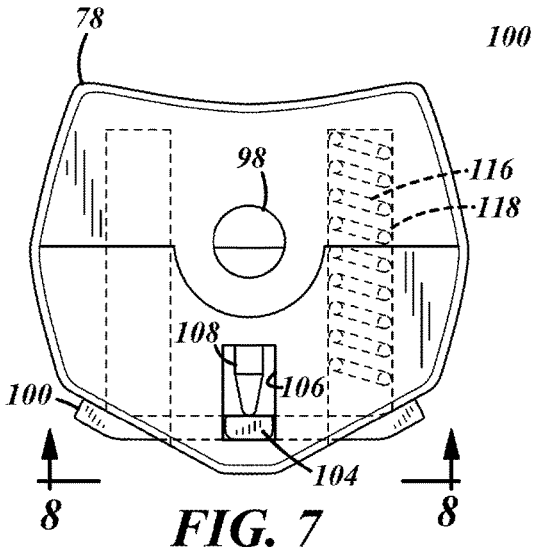
FIG. 7 is an enlarged side view of the rocker button of the kill switch portion of the combined switch assembly.
Figure 8:
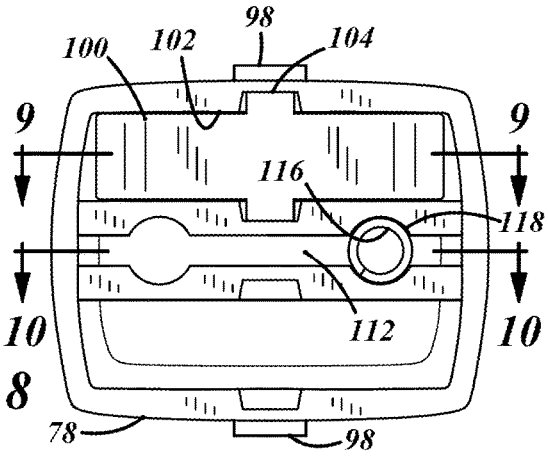
FIG. 8 is an enlarged bottom view of the rocker button taken on lines 8-8 of FIG. 7.
Figure 9:
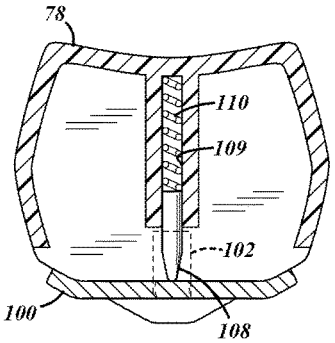
FIG. 9 is a sectional view taken on line 9-9 of FIG. 8.
Figure 10:
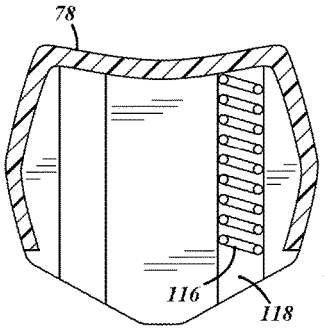
FIG. 10 is a sectional view taken on line 10-10 of FIG. 8.
Figure 11:
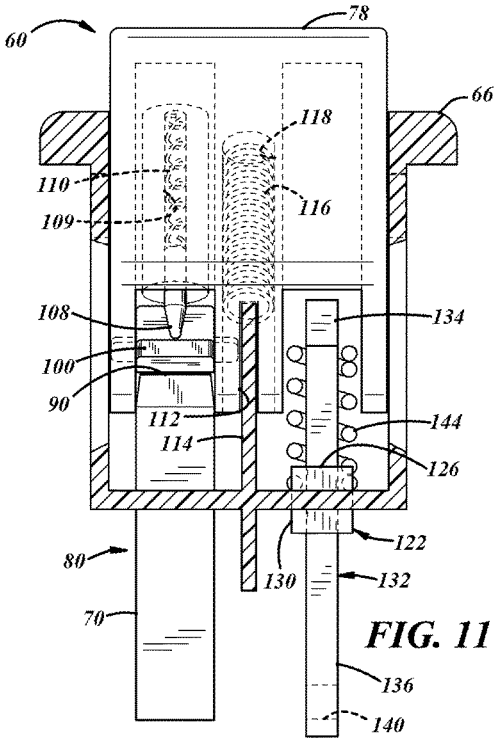
FIG. 11 is a sectional view taken on line 11-11 of FIG. 5.

As shown in FIGS. 5 & 6, the switch assembly 60 has a pair of spaced-apart electrically conductive posts 80, 82 fixed in a bottom wall 86 of the switch housing and adjacent one end projecting into a pocket 88 in this housing to provide a pair of spaced-apart contacts 90, 92 and adjacent the other end projecting exteriorly of the housing to provide the pair of spaced-apart terminals 70, 72, such as spade terminals, each of which is connected to a separate one of the wires 74, 76 such as through push-on female spade electrical connectors 94, 96. The manually movable rocker button 78 is pivotally mounted in the housing to pivot or see-saw about its pivots 98. An electrically conductive connector bar 100 is received in a slot 102 through the button and has projecting tabs 104 slidably received in spaced-apart blind slots 106 in the rocker button. The connector bar 100 can see-saw about a pivot pin 108 slidably received in a blind bore 109 (FIG. 11) in the rocker button and yieldably biased by a spring 110 into contact with the connector bar and toward the distal end of the slots and the bottom of the rocker button. As shown in FIGS. 8 & 11, in assembly, a recess 112 in the rocker button is slidably received over a guide rib 114 of the switch housing and yieldably biased to an open position (shown in FIG. 5) in which the connector bar does not engage at least one or both of the contacts 90, 92 and thus the kill switch is in an open condition, by a spring 116 received in a blind pocket 118 in the rocker button and bearing on a portion of the guide rib 114. When the portion of the rocker button projecting outwardly from the housing is manually depressed, the button pivots clockwise as show in FIGS. 5 & 6 from a first position (FIG. 5) to a second position (FIG. 6) which moves the connector bar into engagement with both of the contacts 90, 92 to close the switch for as long as the rocker button is manually depressed and when released the spring 100 returns the rocker button to the first position in which the connector bar is disengaged from at least one of the contacts to open the switch as shown in FIG. 5.

Figure 12:
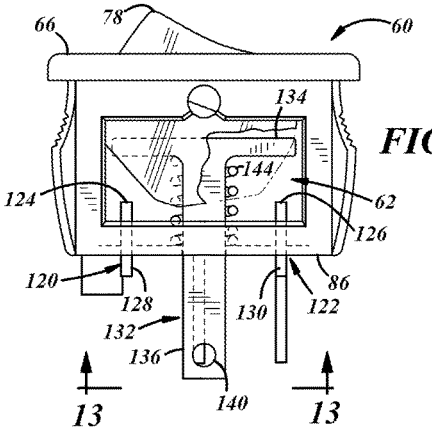
FIG. 12 is an enlarged sectional view of the other side of the combined switch assembly showing the throttle position sensing switch portion.
Figure 13:
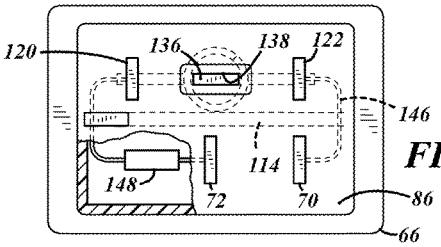
FIG. 13 is a bottom view of the combined switch assembly taken on line 13-13 of FIG. 12.

As shown in FIGS. 12 & 13, the throttle lever position sensor 62 switch has two spaced-apart electrically conductive stub terminals 120, 122 extending through the bottom wall 86 of the housing 66 and at one end providing spaced-apart contacts 124, 126 and adjacent the other end wire connectors 128, 130. A generally T-shaped member 132 has an electrically conductive connector bar 134 spanning the distance between the contacts for engagement with the contacts and an elongate actuator leg 136 slidably received in a slot 138 through the housing, projecting outwardly of the bottom wall 86 of the housing and having adjacent its end a through hole 140 for connecting a wire link 142 to the actuator leg. The connector bar 134 is yieldably biased away from the contacts by a spring 144 encircling the leg and received between the connector bar and the housing. As shown in FIG. 13, one of the stub terminals 122 and thus its contact 126 is electrically connected by a wire 146 to the ground spade terminal 70 and the other stub terminal 120 and its contact 124 is electrically connected through a resistor 148 to the other spade terminal 72. When the connector bar 134 engages and electrically interconnects these contacts, an electrical signal is produced through the spade terminals 70, 72 and wires 74, 76 indicating the throttle lever 38 is near or at its WOT position and thus the throttle valve 34 of the carburetor 32 is near or in its WOT position.

Figure 15:
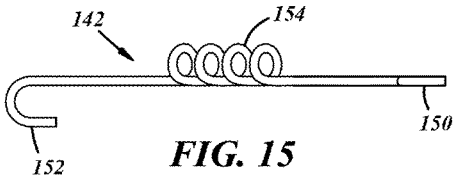
FIG. 15 is an enlarged side view of the wire link.
Figure 16:
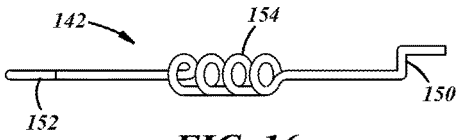
FIG. 16 is a top view of the wire link.
Figure 3:
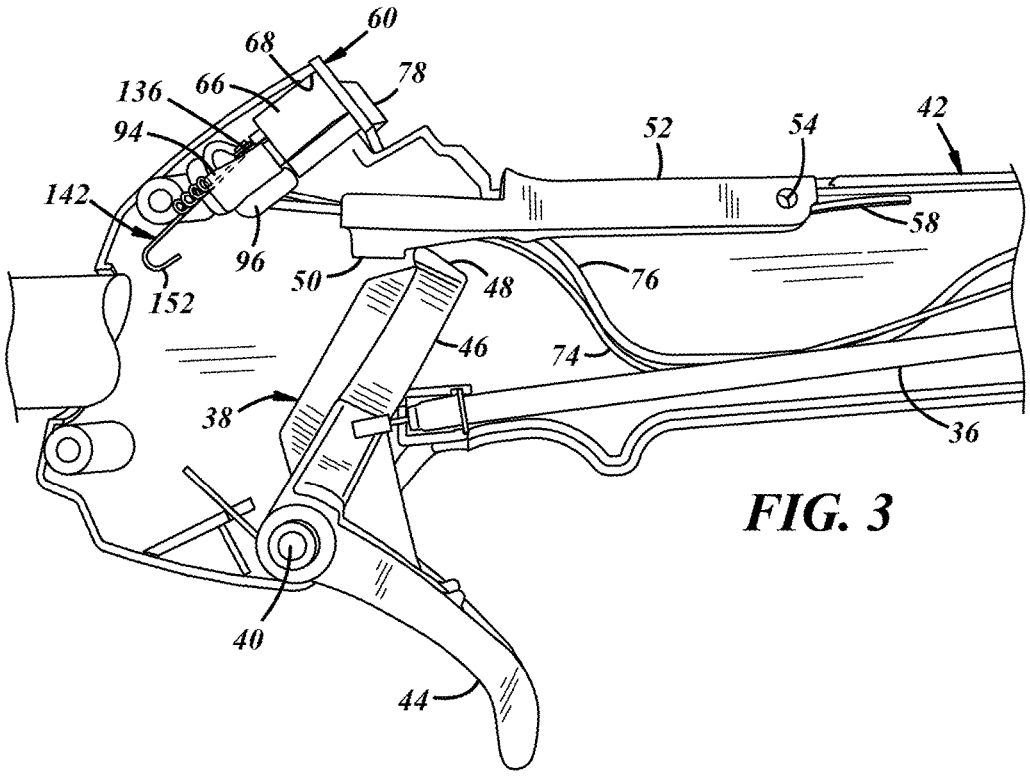
FIG. 3 is an enlarged view of a remote combined kill switch and throttle position sensor switch assembly and related sensor switch actuator wire and manually actuatable throttle lever or trigger in its idle position.
Figure 4:
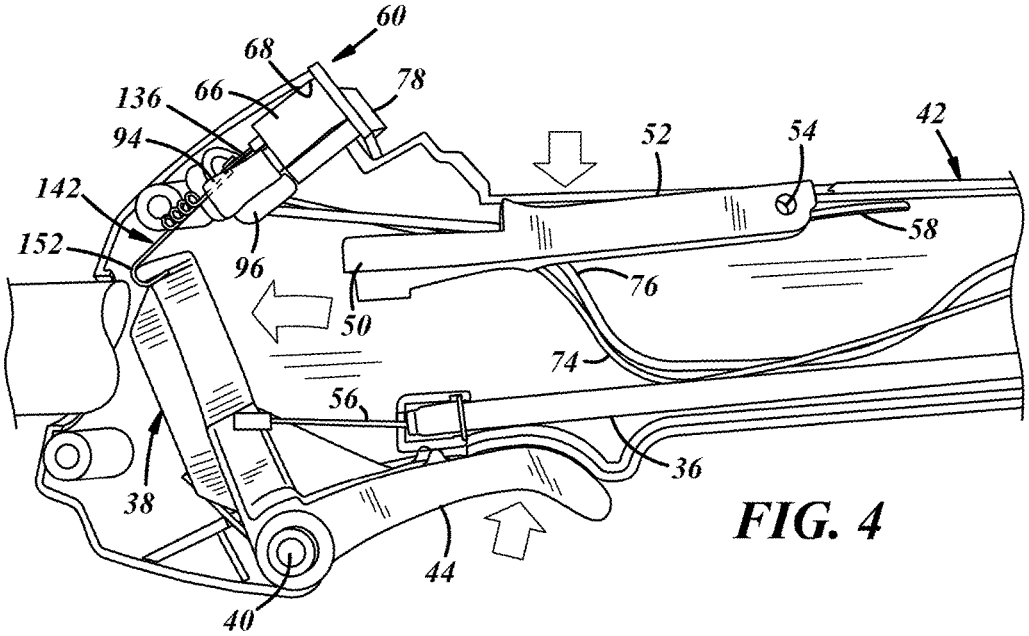
FIG. 4 is an enlarged view of the remote combined kill switch and throttle position sensor switch assembly and related sensor switch actuator wire and manually actuatable throttle lever or trigger in its wide open position.
Figure 14:
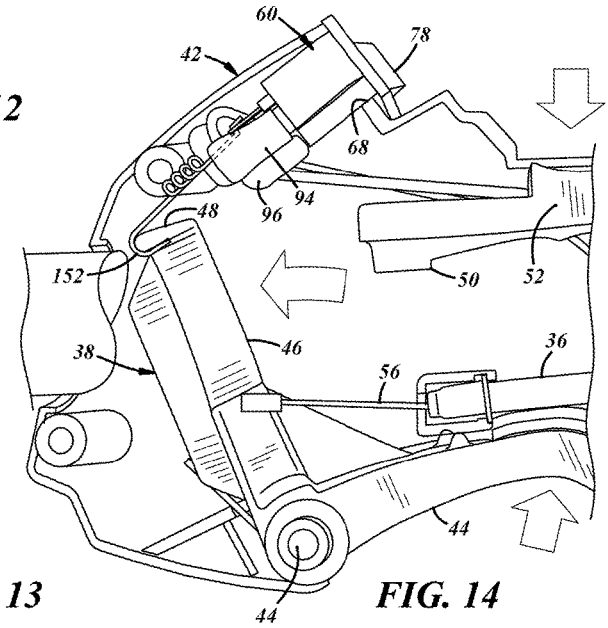
FIG. 14 is an enlarged fragmentary side view of a wire link connecting the throttle position switch with the throttle lever or trigger of the trimmer when near or at its wide open throttle position.

As shown in FIGS. 3, 4 & 14, the throttle position sensor switch 62 is connected for movement of its connector bar into engagement with its contacts 124, 126 and thus its closed position by the wire link 142 which is configured and positioned to be engaged by the dog 48 on the arm 46 of the manually actuated throttle lever 38 when its trigger 44 is moved near or to its wide open throttle position. As shown in FIGS. 15 & 16, the wire link has adjacent one end a bend and return bend or offset portion 150 which in assembly is inserted through the hole 140 in the actuator leg 132 to provide a pivotal connection to the actuator leg and adjacent the other end by a hook 152 engageable by the dog 48 on the throttle lever 38 as its trigger 44 is manually moved toward and approaches its wide open throttle position. To accommodate variations due to dimensional tolerances and to ensure that in the wide open throttle position the sensor switch connector bar 134 firmly engages its contacts 124, 126 and thus closes the throttle position sensor switch 62, the wire link 142 includes a tension coil spring 154 formed between its ends which is somewhat stretched and in tension when the throttle lever 38 is in its wide open position as shown in FIGS. 4 & 14.

Figure 17:
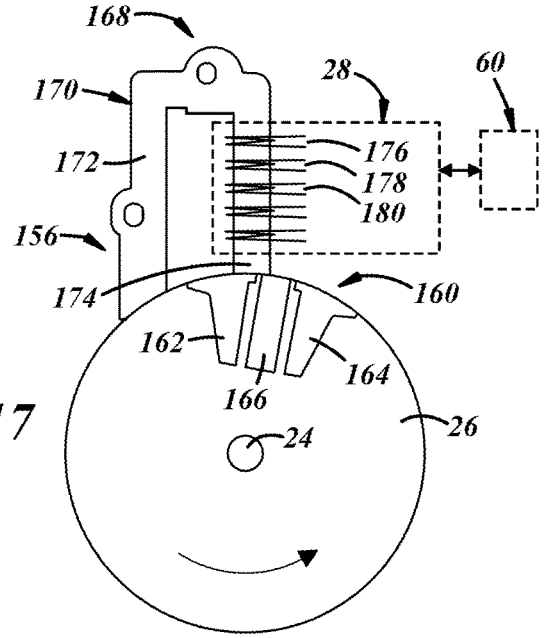
FIG. 17 is a schematic diagram illustrating a capacitor discharge ignition (CDI) system, control module and switch assembly.

FIG. 17 schematically illustrates the magneto system 156, control module 28 and dual switch assembly 60 of the trimmer 20. This magneto system includes a permanent magnet element 160 with pole shoes 162, 164 and a permanent magnet 166 mounted on the flywheel 26 such that when rotating it induces a magnetic flux in a nearby stator assembly 168 of the module 28 as the magnet element passes thereby.

The stator assembly 168 may include a lamstack 170 having a first leg 172 and a second leg 174 (separated from the rotating flywheel by a relatively small and measured air gap which may be about 0.3 mm), a charge coil winding 176, an ignition primary coil winding 178 and a secondary coil winding 180 which may all be wrapped around a single leg of the lamstack. The lamstack 170 may be a generally U-shaped ferrous armature made from a stack of iron plates and may be in a module housing located on the engine. The ignition primary and secondary coil windings 178, 180 may provide a step-up transformer and as is well known by those skilled in the art, the primary winding 178 may have a comparatively few turns of a relatively heavy gauge wire, while the secondary ignition coil winding 180 may have many turns of a relatively fine wire. The ratio of turns between the primary and secondary ignition windings generates a high voltage potential in the secondary winding that is used to fire the spark plug 30 of the engine 22 to provide an electric arc or spark and consequently ignite an air-fuel mixture in the engine combustion chamber.

Figure 18:
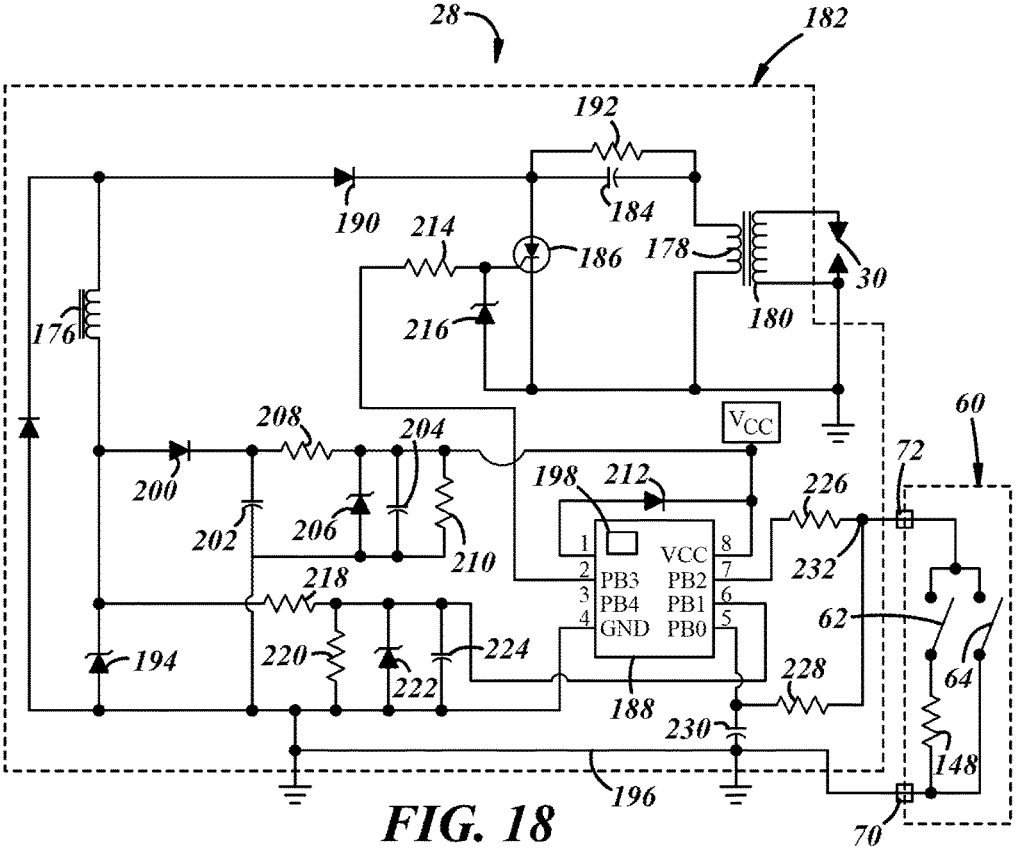
FIG. 18 is a schematic diagram of circuitry of the module and the combined switch assembly.

As shown in FIG. 18, the power charge coil 176 and the ignition primary and secondary coils 178, 180 are coupled to an ignition and control circuit 182 of the control module 28. The term "coupled" broadly encompasses all ways in which two or more electrical components, devices, circuits, etc. can be in electrical communication with one another; this includes, but is not limited to, a direct electrical connection and a connection via an intermediate component, device, circuit, etc. This circuit 182 includes an energy storage and ignition discharge capacitor 184, an electronic ignition switch 186 preferably in the form of a thyristor, such as a silicon controlled rectifier (SCR), and a microcontroller 188. One end of the power charge coil 176 is connected through a diode 190 to the ignition capacitor 184. A resistor 192 may be coupled in parallel with the capacitor. The other end of the coil is connected through a diode 194 to the circuit ground 196. A majority of the energy induced in the power charge winding 176 is supplied to the capacitor 184 which stores this energy until the microcontroller 188 changes the switch 186 to a conductive state to discharge the capacitor 184 through the primary coil 178 of the transformer which induces in the secondary coil 180 a high voltage potential which is applied to the spark plug 30 to provide a combustion initiating arc or spark. More specifically, when the ignition switch 186 is turned "on" (in this case, becomes conductive), the switch 186 provides a discharge path for the energy stored on ignition discharge capacitor 184. This rapid discharge of the ignition capacitor 184 causes a surge in current through the primary ignition coil 178, which in turn, creates a fast-rising electromagnetic field in the primary ignition coil. The fast-rising electromagnetic field induces a high voltage ignition pulse in the secondary ignition coil 180. The high voltage ignition pulse travels to spark plug 30 which, assuming it has the requisite voltage, provide a combustion-initiating arc or spark. Other sparking techniques, including flyback techniques, may be used instead.

The microcontroller 188 may include a memory 198 which can store a look-up table, algorithm and/or code to determine and vary the engine ignition timing relative to top dead center of the piston in the cylinder for various engine operating speeds and conditions. In some applications, the microcontroller 188 may also vary and control the fuel-to-air ratio of the air-and-fuel mixture supplied to the cylinder of the operating engine in response to various engine operating speeds and conditions. Various microcontrollers or microprocessors may be used as is known to those skilled in the art. Suitable commercially available microcontrollers include Atmel model ATTINY and Microchip model 12F. Examples of how microcontrollers can implement ignition timing systems can be found in U.S. Pat. Nos. 7,546,836 and 7,448,358, the disclosures of which are incorporated herein by reference. The memory 198 may be a reprogrammable or flash EEPROM (electrically erasable, programmable read-only memory). In other instances, memory 198 may be external of and coupled to the microcontroller 188. The memory 198 should be construed broadly to include other types of memory such as RAM (random access memory), ROM (read-only memory), EPROM (erasable, programmable read-only memory), or any other suitable non-transitory computer readable medium.

As shown in FIG. 18, the microcontroller 188 includes eight pins. Pin 8 of the microcontroller can be coupled to a voltage source ($V_{CC}$) which supplies the microcontroller with power. To power this microcontroller, the circuit 182 has a diode 200, capacitors 202, 204, a zener diode 206, and resistors 208 and 210 electrically connected in the circuit to the power coil and to pin 8. In this example, pin 1 is a reset pin that is connected through a diode 212 to pin 8. Pin 2 is coupled to the gate of ignition switch 186 via resistor 214, which is wired in the circuit with a zener diode 216, and transmits from the microcontroller 188 an ignition signal which controls the state of the switch 186. When the ignition signal on pin 2 is low, the ignition switch 186 is nonconductive and capacitor 184 is allowed to charge. When the ignition signal is high, the ignition switch 186 is conductive and the ignition capacitor 184 discharges through primary ignition coil 178, thus causing a high-voltage ignition pulse to be induced in secondary ignition coil 180 and applied to the spark plug 30. Thus, the microcontroller can govern the discharge of capacitor 184 by controlling the conductive state of the switch 186.

Pin 3 is a general purpose input or output program port which is not used. Pin 4 is a ground which is connected to the circuit ground.

Pin 6 is a signal input connected to the charge winding 176 via resistors 218 and 220, zener diode 222, and capacitor 224 to receive an electronic signal representative of the position of an engine piston in its combustion chamber usually relative to the top dead center (TDC) position of the piston. This signal can be referred to as a timing signal. The microcontroller 188 can use this timing signal to determine engine speed (RPM), the timing of an ignition pulse relative to the piston(s) TDC position (usually from a look-up table), and whether or not and, if so, when to activate an ignition pulse.

Pin 7 is an output signal pin which is connected to input pin 5 through resistors 226 and 228. So that pin 5 is not affected by noise and radio frequency interference (RFI) produced by the spark plug 30, pin 5 is also connected through a capacitor 230 to the circuit ground 196.

In use, the spade connector terminal 70 of the dual switch 60 is connected to the ground 196 of the circuit. The other connector spade terminal of the dual switch is connected to the junction 232 between the first and second resistors 226 and 228. Preferably the first resistor 226 and the resistor 148 in the sensor switch 62 have the same resistance value which is in the range of 1 to 10 kOhms, desirably 1 to 6 kOhms, and preferably 1 to 4 kOhms. Desirably, the second resistor 228 is in the range of 2 to 2.5 kOhms and preferably 2.2 kOhms. Preferably, the capacitor 230 has a capacitance of about 1 nanofarad.

When the engine is operating, the microcontroller 188 is powered up to receive a signal through pin 6 from which it determines the engine speed or RPM and the position of the piston normally relative to top dead center. Through pin 3, the microcontroller controls the state of the SCR switch 186 to charge the capacitor 184, and typically uses a look-up table stored in memory 198 to determine ignition timing, and changes the state of the ignition switch 186 to discharge the capacitor to produce a spark or arc in the gap of the spark plug 30 to initiate combustion of the fuel-to-air fuel mixture in the engine cylinder. When both of the switches 62 and 64 of the dual switch 60 are open (as shown in FIGS. 3 & 18), the microcontroller 188 produces on pin 5 an alternating signal of zero volts and 5 volts. When only the throttle position sensor switch 62 is closed by the throttle lever 38, due to its resistor 148 and the first and second resistors 226, 228, an alternating signal of substantially zero volts and 2.5 volts is input to pin 5 which the microcontroller interprets as the carburetor throttle valve 34 being near or at its WOT position.

When the throttle lever 38 returns from its WOT position to its part throttle or idle position, the throttle position switch 62 is opened and as long as the kill switch 64 is open, the input to microcontroller pin 5 is again an alternating zero volts and 5 volts and the microcontroller interprets this condition as meaning that the carburetor throttle valve 34 is not at or near its wide open position. If desired, from this change of condition and the engine speed input signal at pin 6, the microcontroller can determine whether the engine is in a rapid comedown or de-acceleration mode and if so initiate a deceleration sequence such as changing the ignition timing and/or increasing or decreasing the fuel supplied to the engine cylinder.

Whenever the kill switch 64 is closed, the input at pin 5 is zero volts which the microcontroller interprets as a command to shut down the engine and "turns on" and "holds on" the ignition switch 186 to prevent further high potential voltage pulses being supplied to the spark plug 30 and thus terminating ignition of the fuel mixture in the cylinder until the engine stops or ceases operation.

The microcontroller may utilize the signal that the carburetor throttle valve is in its wide open position for one or more of a variety of purposes including without limitation changing the ignition timing, initiating an engine control cycle to assist in acceleration of the engine from an idle or part throttle operating state to a wide open throttle operating state which may include advancing the ignition timing and/or enriching the fuel-air mixture supplied to the engine combustion chamber, cancelling a centrifugal clutch engagement limiter feature when the operator advances the carburetor throttle valve from an idle or a fast idle position to WOT position, activating an engine rapid comedown from WOT to idle enhancement feature such as by retarding ignition timing and/or enleaning or enrichening the air-fuel mixture or cutting off the fuel supplied to the engine during the rapid comedown, or for the other engine or product control purposes for which it is desirable to know whether or not the carburetor throttle valve is at or near WOT.

Connecting the same two switch connector terminals, to the contacts of both the throttle position sensor switch and the engine kill switch enables use of the same two wires and connector terminals which otherwise would be required for a conventional kill switch alone, provides a low cost sensing of when the carburetor throttle valve is at or near its fully open or WOT position. Locating the throttle position sensor switch remote from the carburetor and engine, such as in the control handle of a handheld power device provides a clean environment in which this sensor switch is not subjected to dust, dirt, accumulated fuel and/or oil, engine heat and the like. Detaching the throttle position sensor switch from the engine and the carburetor and spacing this switch at least 2" away from the engine usually prevents this switch from being overheated by the operating engine.

The remote location of the throttle position sensor switch eliminates the mounting of a sensor switch on a variety of different carburetors used on different engines which would require many different carburetor mounting positions and/or locations. Placing all of the components of both the throttle position switch and the engine kill switch in a common housing also reduces the cost of this dual switch assembly and facilitates and simplifies mounting this duel switch assembly in the handle of a handheld tool since the switch housing can be configured so that it does not require any change in the handle mounting opening and typically the snap in mounting which would otherwise be used only for a conventional engine kill switch.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A control module for a spark ignited internal combustion engine with a throttle valve movable between idle and wide open throttle positions to control the supply of an air-fuel mixture into a cylinder of the engine by manually moving a trigger of a throttle lever remote from and operably connected to the throttle valve between idle and wide open throttle positions of the trigger lever, comprising:

a microcontroller for controlling the spark initiating combustion of an air-fuel mixture in a cylinder of the engine;

an engine kill switch remote from the engine and having a pair of contacts each connected by a separate one of a pair of wires to the microcontroller to signal the microcontroller to stop operation of the engine when the kill switch is manually actuated to a changed open or closed state of its pair of contacts; and a throttle lever position sensor switch remote from the throttle valve and engine with another pair of contacts each connected to a separate one of the same pair of wires connected to the microcontroller to signal the microcontroller when the trigger of the throttle lever is manually moved so that it is near or at its wide open throttle position.

2. The control module of claim 1 wherein the engine is a component of and powers a handheld tool with a manually engageable housing, the throttle lever, kill switch and throttle lever position sensor switch are all carried by the housing and the throttle lever and the engine kill switch can each be manually actuated from the exterior of the housing.

3. The control module of claim 1 further comprising a switch housing and both the kill switch and the throttle lever position sensor switch are received in and carried by the switch housing.

4. The module of claim 3 which also comprises an electrically conductive connector bar carried by the switch housing and movable between a first position spaced from at least one of the contacts of the pair of contacts of the throttle lever position sensor switch and to a second position electrically interconnecting such pair of contacts of the throttle lever position sensor switch.

5. The module of claim 4 wherein an actuator arm is connected to the connector bar of the throttle lever position sensor switch, is slidably carried by the switch housing, and projects outwardly of the switch housing.

6. The module of claim 5 which also comprises a link connected to the actuator arm and configured to be moved in response to movement of the trigger of the throttle lever near to or at its wide open throttle position to move the connector bar of the sensor switch to its second position.

7. The module of claim 6 which further comprises a spring yieldably biasing the connector bar of the sensor switch to its first position.

8. The module of claim 5 which also comprises another electrically conductive connector bar carried by the switch housing and movable between a first position spaced from at least one of the contacts of the pair of contacts of the kill switch and a second position in which the connector bar electrically interconnects the pair of contacts of the kill switch.

9. The module of claim 4 which also comprises another electrically conductive connector bar carried by the switch housing and movable between a first position spaced from at least one of the contacts of the pair of contacts of the kill switch and a second position in which the connector bar electrically interconnects such pair of contacts of the kill switch.

10. The module of claim 3 which also comprises an electrically conductive connector bar carried by the switch housing and movable between a first position spaced from at least one of the contacts of the pair of contacts of the throttle lever position sensor switch and to a second position electrically interconnecting such pair of contacts of the throttle lever position sensor switch.

11. The module of claim 10 which also comprises a button carried by the housing and manually movable from an exterior portion of the switch housing and operably connected to the connector bar of the kill switch to move such connector bar to its second position in response to manual movement of the button from a first position to a second position of the button.

12. The module of claim 11 wherein the button is yieldably biased to its first position to thereby yieldably retain the connector bar of the kill switch in the first position of such connector bar.

13. The control module of claim 1 which also comprises a switch housing, a pair of electrical connector terminals carried by the switch housing and each connectable from the exterior of the switch housing to a separate one of the pair of wires, one of the contacts of each pair of contacts is connected to one of the connector terminals and the other contact of each pair of the contacts is connected to the other of the connector terminals.

14. The module of claim 13 wherein one of the contacts of the pair of contacts of the throttle position sensor switch is connected by a resistor to one of the connector terminals.

15. The module of claim 13 which also comprises an electrically conductive connector bar carried by the switch housing and movable between a first position spaced from at least one of the contacts of the pair of contacts of the throttle lever position sensor switch and to a second position electrically interconnecting such pair of contacts of the throttle lever position sensor switch.

16. The module of claim 15 which also comprises a button carried by the switch housing, manually movable from an exterior portion of the switch housing and operably connected to the connector bar of the kill switch to move such connector bar to its second position in response to manual movement of the button from a first position to a second position of the button.

17. The module of claim 16 wherein the button is yieldably biased to its first position to thereby yieldably retain the connector bar of the kill switch in the first position of such connector bar.

18. An electric switch for a control module for a spark ignited internal combustion engine, comprising:

an electrically insulative housing;

a pair of spaced-apart electrically conductive connector terminals carried by the housing and configured to be accessible from the exterior of the housing for connecting a separate electric wire to a separate one of the terminals;

a first pair of spaced-apart electrically conductive contacts carried by the housing and each connected to a separate one of the terminals;

a second pair of spaced-apart electrically conductive contacts each connected to a separate one of the terminals;

a first electrically conductive connector carried by the housing and movable between a first position spaced from at least one of the contacts of the first pair of contacts and a second position interconnecting the first pair of contacts;

a second electrically conductive connector received in the housing and movable between a first position spaced from at least one of the contacts of the second pair of contacts and a second position interconnecting the second pair of contacts; and an actuator operably connected to the first connector, extending to an exterior portion of the housing and movable relative to the housing to move the first connector from its first position to its second position.

19. The switch of claim 18 which also comprises a spring yieldably biasing the first connector to its first position.

20. The module of claim 18 which also comprises a button carried by the housing, operably connected to the second bar and manually movable from a portion of the exterior of the housing from a first position to a second position to move the second bar to its second position.

21. The switch of claim 20 which also comprises a spring yieldably biasing the button to its first position.

22. The switch of claim 20 wherein the button is a rocker button pivotally carried by the housing for movement between its first and second positions.

23. The module of claim 18 wherein a portion of the actuator spaced from the exterior portion of the housing is configured for engagement by a link to move the actuator to its second position to move the first connector to its second position.

* * * * *